US005754206A

United States Patent [19]

Bowling et al.

[11] Patent Number: 5,754,206

[45] Date of Patent: May 19, 1998

[54] LOW STRESS DROPLET GENERATOR MOUNT ASSEMBLY

[75] Inventors: Bruce A. Bowling, Beavercreek; David J. Stephens, Springboro, both of Ohio

[73] Assignee: Scitex Digital Printing, Inc., Dayton, Ohio

[21] Appl. No.: 606,427

[22] Filed: Feb. 23, 1996

[51] Int. Cl.[6] ..... B41J 2/02

[52] U.S. Cl. ..... 347/75

[58] Field of Search ..... 347/49, 54, 73, 347/74, 75

[56] References Cited

U.S. PATENT DOCUMENTS

| | | | |
|---|---|---|---|
| 4,131,899 | 12/1978 | Christon | 347/71 |
| 4,620,195 | 10/1986 | Eblen et al. | 347/49 |
| 4,791,434 | 12/1988 | Wills | 347/49 |
| 4,841,310 | 6/1989 | Hoffman | 347/75 |
| 5,212,502 | 5/1993 | Bowling | 347/49 |

*Primary Examiner*—Matthew V. Nguyen
*Attorney, Agent, or Firm*—Barbara Joan Haushalter

[57] ABSTRACT

A mounting apparatus holds in position a droplet generator assembly to be mounted in a continuous ink jet printing system. The droplet generator assembly comprises a pair of conical slots and a pair of conical apertures, located on opposing sides of the droplet generator. A resonator clamping plate includes a plurality of mating protrusions. A resonator support includes a plurality of spherical protrusions. A holding force, such as a screw, securely holds the assembled structure. The clamp and support interact with the conical slots and apertures to locate and exactly constrain the droplet generator. With the mounting structure of the present invention, the six degrees of freedom of adjustment are controlled.

11 Claims, 1 Drawing Sheet

LOW STRESS DROPLET GENERATOR MOUNT ASSEMBLY

TECHNICAL FIELD

The present invention relates to continuous ink jet printers and, more particularly, to mounting a drop generator in an ink-jet printhead.

BACKGROUND ART

Ink jet printing systems are known in which a print head defines one or more rows of orifices which receive an electrically conductive recording fluid, such as for instance a water base ink, from a pressurized fluid supply manifold and eject the fluid in rows of parallel streams. Printers using such print heads accomplish graphic reproduction by selectively charging and deflecting the drops in each of the streams and depositing at least some of the drops on a print receiving medium, while others of the drops strike a drop catcher device.

Current holding techniques for droplet generator assemblies require holes to be bored through the generator body. Dowel pins or tubes are then pressed into these holes with an instant adhesive. The ends of the pins or tubes are strapped down with steel plates and screws into a yoke or holder. Unfortunately, existing assembly methods have several problems. For instance, the use of dowel pins requires precision tolerances and higher fabrication costs. Also, press-fitting dowels into the corresponding holes produces high stress that negatively affects droplet generator performance.

Another problem with the current art is that through holes in a droplet generator negatively affect stimulation. The locations of the drop break-offs are controlled to occur within a predetermined charge region, downstream from the orifice plate. Such control is effected by applying an energy signal of predetermined frequency and amplitude(s) to the ink filaments. Such filament break-up control, called stimulation, maintains uniform drop size and drop spacing, as well as controlling location and timing of the drop break-off. Consequently, good stimulation is a critical performance feature.

Existing holding techniques for droplet generator assemblies use large forces to hold the pins/tubes in the yoke, which over-constrains the assembly by bending the pins and straps. Even with this loading or stressing, one or more degrees of freedom are constrained by friction, which could have the undesirable effect of allowing the droplet generator to move during shipping.

It is seen then that there is a need for an apparatus for mounting components of an ink jet printhead which overcomes the problems associated with existing techniques and reduces labor and material costs.

SUMMARY OF THE INVENTION

This need is met by the system according to the present invention, wherein an exactly constrained, low stress, and inexpensive droplet generator mount assembly is provided.

In accordance with one aspect of the present invention, a mounting apparatus is provided for holding a droplet generator assembly of a continuous ink jet printer. The mounting assembly comprises means for controlling six degrees of freedom of adjustment. The six degrees of freedom of adjustment include three degrees of freedom of translation and three degrees of freedom of rotation. The first degree of freedom of translation comprises a height adjustment of the resonator relative to the charge plate; the second degree of freedom of translation comprises an alignment adjustment for aligning the plurality of jets with respect to the plurality of charge leads; and the third degree of freedom of translation comprises a reciprocal adjustment for moving the plurality of jets relative to the charge plate. In the apparatus of the present invention, the first degree of freedom of rotation comprises a first parallel adjustment for aligning the plurality of jets parallel to the charge plate face; the second degree of freedom of rotation comprises a second parallel adjustment for aligning the array of orifices parallel to the charge plate face; and the third degree of freedom of rotation comprises a third parallel adjustment for aligning the orifice plate parallel to the top of the charge leads. The mounting apparatus of the present invention comprises two conical slots and two conical apertures located on opposite sides of the droplet generator assembly. A clamp and a support interact with the conical slots and apertures to locate and exactly constrain the droplet generator.

The mounting assembly according to the present invention provides a variety of advantages. First, the six degrees of freedom of adjustment of the droplet generator are exactly constrained. In addition, the mounting assembly is low stress. A third advantage of the present invention is that the mounting assembly does not negatively affect stimulation. Finally, the holding technique of the present invention reduces parts count from approximately twenty-three parts in prior art droplet generator assembly holding mechanisms, to three parts, thereby reducing labor and material costs.

Other objects and advantages of the invention will be apparent from the following description, the accompanying drawings and the appended claims.

DETAILED DESCRIPTION OF THE PREFERRED EMBODIMENTS

The present invention provides a means for holding in position within a mounting structure a droplet generator assembly to be mounted in a continuous ink jet printing system. With the mounting structure of the present invention, the droplet generator assembly is exactly constrained and the six degrees of freedom of adjustment are controlled.

Figure 1:
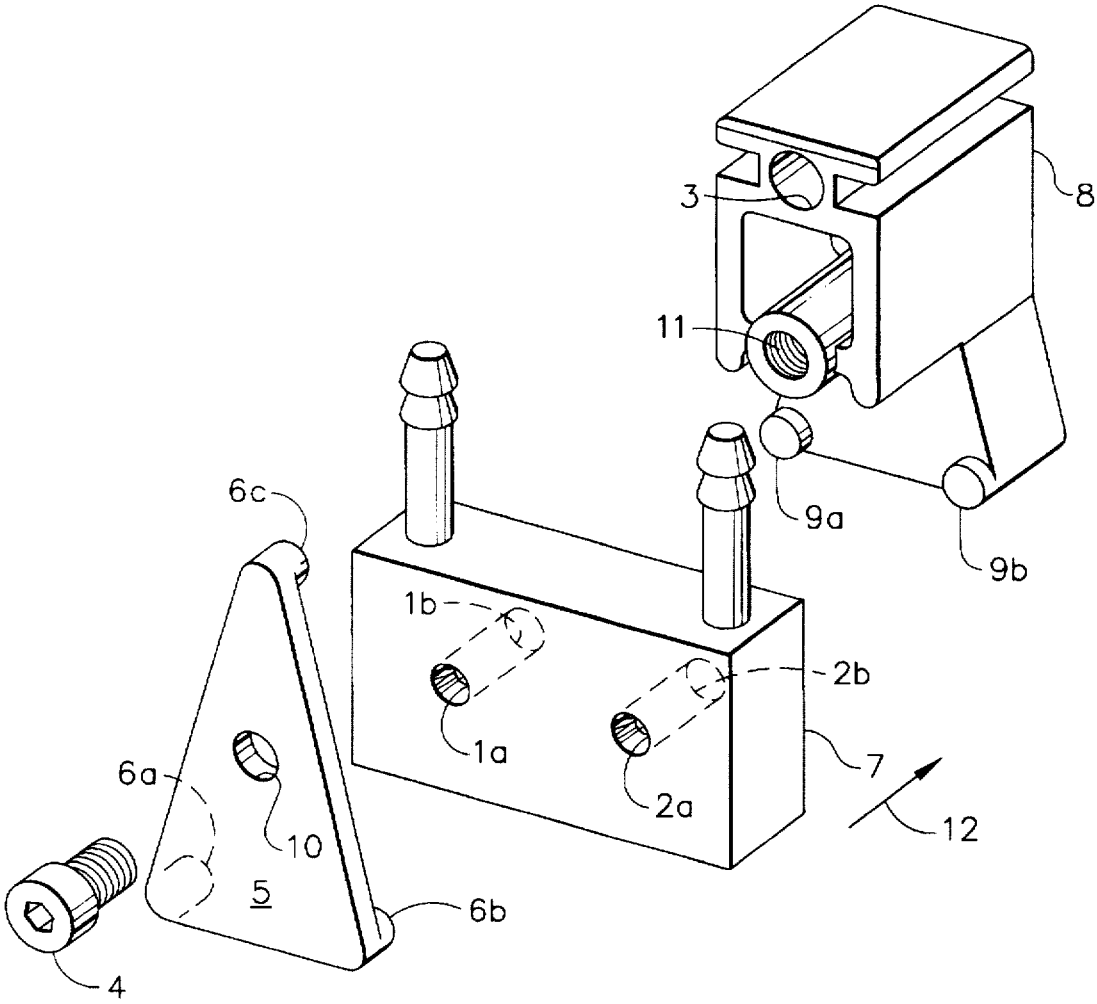
FIG. 1 is an exploded view of the components of the mounting assembly of the present invention.
Figure 2:
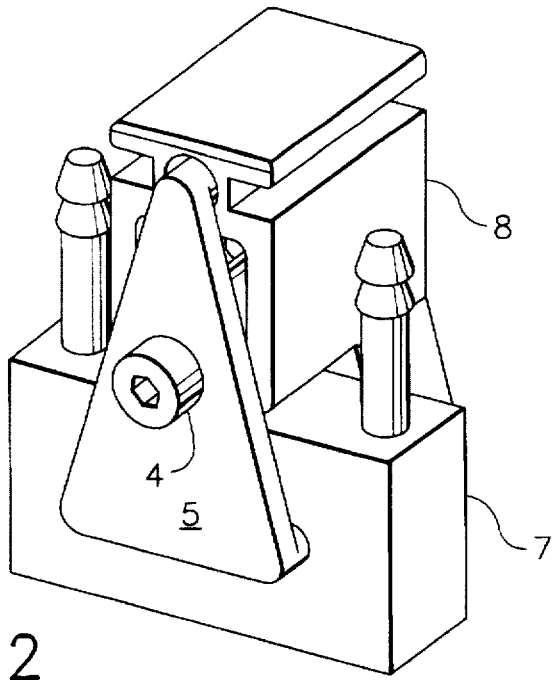
FIG. 2 is an assembled view of the mounting assembly of FIG. 1.

Referring now to the drawings, in FIG. 1 an exploded view of the components of the mounting assembly of the present invention is illustrated; and in FIG. 2 an assembled view of the mounting assembly of FIG. 1 is illustrated. The mounting assembly holds a droplet generator assembly 7 in position for mounting in a printhead of a continuous ink jet printing system. The droplet generator assembly comprises a first conical slot 1*a* spaced apart from a first conical aperture 2*a* on one side of the droplet generator, and a second conical slot 1*b* correspondingly spaced apart from a second conical aperture 2*b* on the opposing side of the droplet generator. In a preferred embodiment of the present invention, the first and second conical slots are directly opposite each other along an imaginary axis through the droplet generator 7, in the direction of arrow 12; and the first and second conical apertures 2*a* and 2*b* are also directly opposite each other along an imaginary axis through the droplet generator 7, also in the direction of arrow 12. In a preferred embodiment of the present invention, the conical features are machined into the resonator, to a depth of approximately one-quarter of the resonator thickness.

The mounting assembly comprises a resonator clamping plate 5, including a plurality of spherical mating protrusions 6 and an aperture 10; a resonator support 8, including spherical protrusions 9, spherical aperture 11, and conical slot 3; and a holding force, such as a screw 4, to securely hold the assembled structure.

When the structure is assembled, the droplet generator assembly 7 is exactly constrained, i.e., the six degrees of freedom are controlled. Two of the mating protrusions 6*a* and 6*b* are receivable into conical slot 1*a* and conical aperture 2*a*, respectively; and spherical protrusions 9*a* and 9*b*, are receivable into conical slot 1*b* and conical aperture 2*b*, respectively. A third mating protrusion 6*c* mates directly with conical slot 3 of resonator support 8.

Conical slots 1 are used in tandem, which is permissible in exact constraint theory, to generate two degrees of freedom control. Conical apertures 2 are also used in tandem to generate three degrees of freedom control. Finally, conical slot 3 controls the sixth degree of freedom. It should be noted that all of the exact constraint geometry is easily reproduced through C.N.C., die or investment casting processes. It will be obvious to those skilled in the art that the spirit of the invention covers loose pieces which would mimic a spherical-end feature, such as, but not limited to, ball bearings.

Continuing with FIGS. 1 and 2, the holding force 4 is insertable through aperture 10 and into spherical aperture 11 of resonator support 8. The single screw 4 yields enough force to hold the assembly securely, as shown in FIG. 2.

In the assembly sequence, the droplet generator assembly 7 is placed onto the spherical protrusions 9 of resonator support 8, which engages the conical apertures 2 on the droplet generator assembly 7. Mating protrusions 6*a* and 6*b* of the resonator clamping plate 5 engage the conical slots 1*a* and 1*b* on the droplet generator assembly 7. Mating protrusion 6*c* then engages the resonator support 8 in area 3 to finish locating the assembly together. Holding force 4 is installed through the resonator clamping plate 5 and into the resonator support 8, and torqued to a preferred value of not greater than 14 in/lbs, to complete the assembly process.

The result is an exactly constrained, low stress, and inexpensive mounting assembly for holding a droplet generator assembly without negatively affecting stimulation. Although the preferred mode of practicing the invention has been described with reference to an ink jet print head for a continuous ink jet printer, the principle of the present invention can also be applied to a wide variety of ink jet printers.

INDUSTRIAL APPLICABILITY AND ADVANTAGES

The mounting apparatus according to the present invention is useful in continuous ink jet printers. The mounting assembly holds a droplet generator assembly in position for mounting in a printhead of a continuous ink jet printing system. The mounting apparatus of the present invention provides a clamp and support to locate and exactly constrain the droplet generator. A holding force, such as a single screw, securely holds the assembly.

Having described the invention in detail and by reference to the preferred embodiment thereof, it will be apparent that other modifications and variations are possible without departing from the scope of the invention defined in the appended claims.

What is claimed is:

1. A mounting apparatus for a continuous ink jet printer comprises:

a droplet generator assembly having a plurality of first conical features located on a first side of the droplet generator assembly, and a plurality of second conical features located on an opposing side of the droplet generator assembly;

a resonator clamping plate for mating with the first conical features;

a resonator support for mating with the second conical features; and a holding force to securely hold the droplet generator assembly, the resonator clamping plate, and the resonator support as an assembled structure.

2. A mounting apparatus as claimed in claim 1 wherein the plurality of first conical features comprises a first conical slot and a first conical aperture.

3. A mounting apparatus as claimed in claim 2 wherein the plurality of second conical features comprises a second conical slot and a second conical aperture.

4. A mounting apparatus as claimed in claim 3 wherein the first and second conical slots are used in tandem to generate two degrees of freedom control.

5. A mounting apparatus as claimed in claim 3 wherein the first and second conical apertures are used in tandem to generate three degrees of freedom control.

6. A mounting apparatus as claimed in claim 1 wherein the resonator support comprises a plurality of spherical protrusions, a spherical aperture, and a third conical slot.

7. A mounting apparatus as claimed in claim 6 wherein the third conical slot generates one degree of freedom control.

8. A mounting apparatus as claimed in claim 6 wherein the resonator clamping plate comprises a plurality of spherical mating protrusions and an aperture.

9. A mounting apparatus as claimed in claim 8 wherein the plurality of spherical mating protrusions of the resonator clamping plate mate with the plurality of spherical protrusions of the resonator support.

10. A mounting apparatus as claimed in claim 8 wherein the holding force comprises a single screw.

11. A mounting apparatus as claimed in claim 10 wherein the holding force is insertable through the aperture of the resonator clamping plate and into the spherical aperture of the resonator support.

* * * * *